United States Patent [19]

Scott

[11] Patent Number: 4,738,232

[45] Date of Patent: Apr. 19, 1988

[54] FUEL PRIMER FOR FLOAT TYPE CARBURETORS

[75] Inventor: William A. Scott, Mt. Zion, Ill.

[73] Assignee: 501 Tillotson Ltd., Tralee, Ireland

[21] Appl. No.: 903,214

[22] Filed: Sep. 2, 1986

[51] Int. Cl.[4] ..... F02M 1/16

[52] U.S. Cl. ..... 123/187.5 R; 261/64.6; 261/DIG. 8

[58] Field of Search ..... 123/187.5 R; 261/DIG. 8, 64.6

[56] References Cited

U.S. PATENT DOCUMENTS

| | | | |
|---|---|---|---|
| 1,384,429 | 7/1921 | Cole | 261/64.1 |
| 3,345,045 | 10/1967 | Tuggle | 123/187.5 R |
| 3,430,933 | 3/1969 | Taggart | 123/187.5 R |
| 4,204,511 | 5/1980 | Morris | 123/187.5 R |

FOREIGN PATENT DOCUMENTS

| | | | |
|---|---|---|---|
| 55-164747 | 12/1980 | Japan | 123/187.5 R |

*Primary Examiner*—Andrew M. Dolinar

*Attorney, Agent, or Firm*—Harness, Dickey & Pierce

[57] ABSTRACT

A fuel primer for float type carburetors for small internal combustion engines is disclosed. The fuel primer is associated with the fuel bowl of a float type carburetor. The fuel bowl is coupled with a fuel inlet, an atmospheric outlet vent, and a nozzle. The fuel inlet is coupled with the fuel source and the nozzle is coupled with the carburetor venturi. The primer includes a mechanism coupled with the outlet vent for introducing a pressurized flow into the fuel bowl. The pressurized flow introduces fuel from the fuel bowl into the carburetor venturi, which, in turn, enables fuel to pass into the combustion chamber of the internal combustion engine.

16 Claims, 1 Drawing Sheet

FUEL PRIMER FOR FLOAT TYPE CARBURETORS

BACKGROUND AND SUMMARY OF INVENTION

The present invention relates to carburetors for small internal combustion engines and more particularly, to fuel primers for float type carburetors providing fuel into the combustion chamber prior to starting of the internal combustion engine.

Small internal combustion engines, especially marine outboard motors with float type carburetors and the like, generally need to be primed before starting of the engine occurs. Priming is the pre-drawing of fuel into the combustion chamber of the cylinders prior to the starting of the internal combustion engine. Generally, after an internal combustion engine sits for a long period of time, e.g. two weeks or greater, fuel in the combustion chamber evaporates. This evaporation of fuel necessitates priming of the combustion chamber so that fuel is present to start the engine. A dry combustion chamber generally causes the operator to pull on the starting cord several more times than he would if the combustion chamber contained a supply of fuel.

Generally, the starting procedure for an internal combustion engine having a float type carburetor is as follows. The choke is set in an on position and the throttle is set in its start position. The carburetor bowl is filled with fuel and then the engine cord is pulled several times. Generally, during the pulling of the cord, the engine fires and quits due to excessive fuel entering the combustion chamber. The choke is then put in the off position. Several pulls of the rope are usually required after choke off to start and run. Sometimes the engine will quite again and the above procedure must be repeated until engine eventually starts and continuously runs. Normally, several pulls (approximately 8–10) of the starter cord are needed to accomplish starting of the internal combustion engine.

In some applications of outboard motor carburetor designs, attempts were made to provide a spring loaded breakaway butterfly choke for enabling proper air/fuel ratio to be passed into the combustion chamber. These designs, however, would not accomplish a start and run condition without stopping, therefore, defeating the purpose of the device. Thus, the art has the disadvantage that the engine can not be started and continue to run without pulling on the engine cord several times to prime the engine. Also, the art does not provide an operator with sufficient time to move the butterfly choke from a closed, to a run position while the engine is warming up. Thus, the engine is unable to run without stopping from a start up to a continuous run condition.

Accordingly, it is an object of the present invention to overcome the disadvantages of the above art. The present invention provides the art with a fuel primer for float type carburetors. The present invention enables an internal combustion engine, having a float type carburetor to start and continue to run without stopping during an intended warm-up period. The present invention enables the operator to position the butterfly choke from a closed, to a run position during engine warm-up without stalling. Also, the present invention enables fuel to be drawn into the combustion chamber of the engine cylinders utilizing existing inlets and outlets of conventional float type carburetors.

The float type carburetor fuel primer of the present invention is associated with a fuel bowl of a float type carburetor. The fuel bowl is generally coupled with a fuel inlet and has an outlet to ambient air. Also, the fuel bowl is associated with the carburetor venturi through a nozzle which discharges fuel from the fuel bowl into the combustion path. The fuel inlet is associated with a fuel source for enabling fuel to enter into the fuel bowl. The fuel primer includes a mechanism coupled with the atmospheric outlet vent for introducing a pressurized flow, via the atmospheric outlet vent, into the fuel bowl. The pressurized flow introduces fuel in the fuel bowl to pass, via the nozzle, into the combustion path which, in turn, enables the fuel to pass into the combustion chamber.

Generally, the mechanism for introducing pressurized flow into the fuel bowl includes a resilient mechanism coupled with the atmospheric outlet vent. The resilient mechanism pressurizes the primer upon compression. An activation mechanism is associated with the resilient mechanism. The activating mechanism compresses the resilient means upon activation, thus activating the primer.

From the following description and claims taken in conjunction with the accompanying drawings, other objects and advantages of the present invention will become apparent to one skilled in the art.

DETAILED DESCRIPTION OF THE PREFERRED EMBODIMENT

Figure 1:
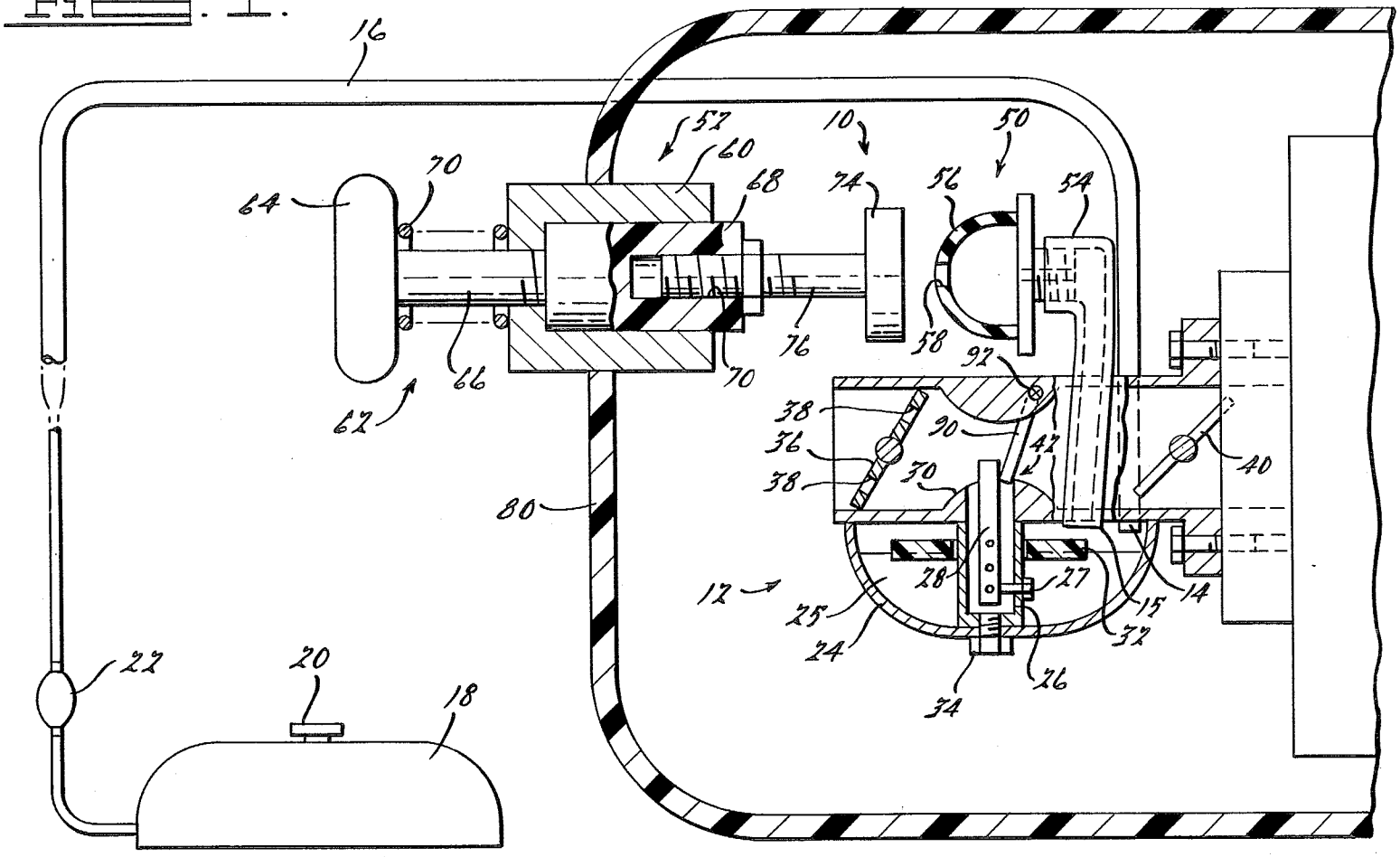
FIG. 1 is a partial cross-section view of a float type carburetor including a fuel primer in accordance with the present invention.

Referring to FIG. 1, a fuel primer is shown and designated with reference numeral 10. The fuel primer 10 is associated with a carburetor 12 of a small internal combustion engine. The carburetor is of a float type having a butterfly type choke. The carburetor 12 has a fuel inlet 14 connected to a conduit 16 which, in turn, communicates with a fuel tank 18 having a vent to atmosphere 20. The fuel tank 18 may be of the gravity type or a pressure bulb 22 may be inserted into the conduit 16 for supplying fuel to the carburetor 12.

The fuel inlet 14 and an outlet 15 communicate with a fuel bowl 24. The fuel bowl 24 includes a stand pipe 26 having a nozzle 28, positioned within the stand pipe 26, for enabling fuel to pass into the venturi 30. An air bleed outlet mechanism 42 is associated with the stand pipe 26. A float 32 is positioned about the stand pipe 26 for indicating the level of fuel 25 in the bowl 24. A nut 34 is associated with the fuel bowl 24 for fastening the bowl to the body.

The carburetor 12 includes a butterfly choke 36 having at least one aperture 38 therein positioned within the venturi 30. The venturi 30 has a butterfly valve 40 for metering air and fuel flow into the engine combustion chamber. The venturi 30 is positioned and secured onto a manifold 31 such that the fuel entering the combustion chamber from the venturi flows toward the combustion chamber.

The primer 10 comprises a pressurizing mechanism 50 associated with the fuel bowl atmospheric outlet vent 15. A mechanism 52 for activating the pressurizing mechanism 50 is positioned adjacent the mechanism 50.

The pressurizing mechanism 50 includes a conduit 54 coupled with the outlet 15 for enabling air flow into and from the fuel bowl 24. A resilient bulb 56 is associated with the other end of the conduit 54. The resilient bulb 56, generally formed from a conventional rubberized material, enables compression of the fluid in the bulb 56 and conduit 54 which, in turn, passes pressurized fluid through the outlet into the fuel bowl 24 as described herein. The bulb 56 has an aperture 58 in its surface for enabling the bowl 24 to vent to ambient air when the bulb 56 is not being compressed. The size of the bulb 56 may be changed which, in turn, changes the volume of fluid entering the fuel bowl 24 controlling the amount of fuel entering the venturi 30.

The activating mechanism 52 includes a housing 60 having a plunger 62 slidably secured within the housing 60. The plunger 62 has a stop 64, a stem 66, and a body portion 68 which slidably engages the housing 60. The stem 66 has a biasing member 70, preferably a helical spring, positioned about the exterior of the stem 66 biased between the stop 64 and housing 60 for enabling reciprocal sliding movement of the body 68 within the housing 60. The body 68 has an aperture 70 for enabling a second plunger 72 to be retractably and extendably secured in the body 68 of the first plunger 62. The second plunger has an overall T-shape having a stop 74 and a threaded stem 76. The threaded stem 76 enables the stop 72 to be rotated and retracted into and extend from the body portion 68. This positioning of the second plunger 72, with respect to the first plunger 62, enables the volume of air entering into the fuel bowl 24 to be controlled. The volume is controlled by positioning the stop 74 of the plunger 72 a desired distance from the body 68 of the plunger 62 which enables the bulb 56 to be compressed enabling a desired volumetric amount of pressurized air to enter into the fuel bowl 24 which, in turn, introduces a desired amount of fuel into the venturi and into the combustion chamber.

The air bleed mechanism 42 includes a conduit 90 having one end associated with the stand pipe 28 and the other end having a one way valve 92. The one way valve 92 is open to ambient air and is closed to fuel attempting to exit during priming. Once the engine begins to start and continues to run, air may be drawn into the stand pipe 26 via conduit 90 and one way valve 92. Also, ambient air may enter into the fuel bowl 24 through aperture 58 in bulb 56 for venting of the fuel bowl 24.

In a conventional marine outboard motor, the housing 60 of the activation means is positioned on the housing 80 of the marine outboard motor. The plunger 62 is on the exterior of the housing 80 enabling activation of the primer from outside the housing 80. The housing 80 of the marine outboard motor protects the open resilient bulb 56 from the elements and enables only air within the housing 80 to enter the bowl 24 thus, keeping out the elements such as rain, dew, and the like from contaminating the fuel supply.

The primer of the present invention functions as follows. The fuel bulb 22 is pumped several times drawing fuel from the tank 18 into the fuel bowl 24 via conduit 16 and the fuel inlet 14. Fuel 25 is drawn into the fuel bowl 24 until the float 32 stops flow of the fuel into the fuel bowl 24. At this time, the fuel bowl 24 is full of fuel and ready for priming by the present invention.

Generally, the plunger 62 is pushed into the housing 60 which, in turn, forces stop 74 of plunger 72 against the resilient bulb 56. The compressing of bulb 56 causes air within the bulb 56 and conduit 52 to be pressurized and the pressurized air flows into the fuel bowl 24 via the outlet 15. The pressurized air entering the fuel bowl 24 forces fuel 25 to enter the nozzle 28, via stand pipe inlet 27, and out into venturi 30. Fuel is introduced into the venturi 30 and flows into the combustion chamber. Depending upon the volumetric size of the bulb 56, a controlled amount of fuel can be introduced into the combustion chamber for enabling starting of the engine.

The butterfly choke 36 having apertures 38 enables air to bypass the choke 36 while the operator is attempting to start the engine which, in turn, enables the engine to continue to run while providing the operator with time to shift the choke, during the warm up stage, from a closed to an open position. Thus, the engine starts and continues to run with a minimum amount of pulls on the engine cord.

While the above summarizes the present invention, it will become apparent to those skilled in the art that modifications, variations, and alterations may be made without deviating from the scope and fair meaning of the subjoined claims.

What is claimed is:

1. A fuel primer for float type carburetors having a fuel bowl, the fuel bowl coupled with a fuel inlet, an outlet vent, and a nozzle, the fuel inlet cupled with a fuel source and the nozzle coupled with an intake path, the primer comprising:

means coupled with said outlet for introducing a pressurized fluid flow in said fuel bowl, said pressurized fluid flow introducing fuel in said fuel bowl into said intake path; and means associated with said fuel bowl and ambient air for automatically enabling ambient air flow to enter into said fuel bowl upon start up and for enabling fuel flow to enter into said intake path from said fuel bowl during pressurization of said fluid while preventing said fuel flow from exiting said air flow means during pressurization of said fluid such that air enters an engine through said means associated with said fuel bowl and said engine begins to run and continues to run during start up enabling an operator to move a choke from a closed to an open position for continuous operation of the engine.

2. The primer according to claim 1 wherein said means includes resilient means coupled with said outlet vent, said resilient means introducing said pressurized flow into said fuel bowl upon compression of said resilient means; and activation means associated with said resilient means, said activation means compressing said resilient means upon activation of said activation means.

3. The primer according to claim 2 wherein said resilient means includes an outlet, said outlet being blocked by said activation means upon compression of said resilient means and said outlet being unblocked after compression of said resilient means enabling said resilient means to expand and enable said fuel bowl to vent through said resilient means to ambient air.

4. The primer according to claim 3 wherein said resilient means being a resilient bulb member having an aperture therein.

5. The primer according to claim 2 wherein said activation means includes a housing;

a first plunger slidably secured in said housing;

a biasing member associated with said first plunger for enabling reciprocating sliding movement of said first plunger in said housing; and a second plunger retractably and extendably associated with said first plunger, said second plunger compressing said resilient means for pressurizing said primer.

6. The primer according to claim 1 wherein a butterfly choke having at least one aperture being positioned in the combustion path for enabling air flow into said combustion path.

7. A fuel primer for float type carburetors having a fuel bowl, the fuel bowl associated with a fuel inlet, an outlet vent, and a nozzle, the fuel inlet being coupled with a fuel source and the nozzle coupled with an intake path, the primer comprising:

resilient means coupled with said outlet vent for introducing a pressurized flow, through said outlet vent, into said fuel bowl upon compression of said resilient means, said pressurized flow introducing fuel in said bowl, through said nozzle, into said intake path; and activation means associated with said resilient means, said activation means compressing said resilient means upon activation of said activation means, said activation means including a housing;

a first plunger slidably secured in said housing;

a biasing member associated with said first plunger for enabling reciprocating sliding movement of said first plunger in said housing;

a second plunger retractably and extendably coupled with said first plunger, said second plunger compressing said resilient means for pressurizing said primer.

8. The primer according to claim 7 wherein said resilient means includes an outlet vent, said outlet vent being blocked by said activation means upon compression of said resilient means and said outlet vent being unblocked after compression of said resilient means enabling said resilient means to expand and enable said fuel bowl to vent through said resilient means to ambient air.

9. The primer according to claim 8 wherein said resilient means being a resilient bulb member having an aperture therein.

10. The primer according to claim 7 wherein air bleed means associated with said fuel bowl for enabling one way air flow into said fuel bowl.

11. The primre according to claim 7 wherein a butterfly choke having at least one aperture being positioned in the combustion path for enabling air flow into said combustion path.

12. A primer for marine outboard motors having float type carburetors with a fuel bowl, the fuel bowl coupled with a fuel inlet, an outlet vent, and a nozzle, the fuel inlet coupled with a fuel source and the nozzle coupled with an intake path, the carburetor being surrounded by a housing of the marine outboard motor, the primer comprising:

resilient means coupled with said outlet vent for introducing a pressurized fluid flow, via said outlet, into said fuel bowl upon compression of said resilient means, said pressurized fluid flow introducing fuel in said bowl, via said nozzle, into said intake path;

delay means associated with said nozzle and ambient air for automatically enabling one way ambient air flow to enter into said nozzle upon start up and for enabling fuel flow to enter into said intake path from said nozzle during pressurization of said fluid while preventing said fuel flow from exiting said delay means during pressurization of said fluid such that air enters the outboard motor through said delay means and said outboard motor begins to run and continues to run during start up enabling an operator to move a choke from a closed to an open position for continuous operation of the outboard motor; and activation means mounted on said marine outboard motor housing and associated with said resilient means, said activation means compressing said resilient means upon activation of said activation means.

13. The primer according to claim 12 wherein said resilient means includes an outlet vent, said outlet being blocked by said activation means upon compression of said resilient means and said outlet being unblocked after compression of said resilient means enabling said resilient means to expand and enable said fuel bowl to vent through said resilient means to ambient air.

14. The primer according to claim 13 wherein said resilient means being a resilient bulb member having an aperture therein.

15. The primer according to claim 12 wherein said activation means includes a housing mounted on said outboard housing;

a first plunger extending from the exterior of the marine outboard housing, said first plunger slidably secured in said housing;

a biasing member associated with said first plunger for enabling reciprocating sliding movement of said first plunger in said housing; and a second plunger within the interior of the marine outboard motor housing, said second plunger retractably and extendably associated with said first plunger, said second plunger compressing said resilient means for pressurizing said primer.

16. The primer according to claim 12 wherein a butterfly choke having at least one aperture being positioned in the combustion path for enabling air flow into said combustion path.

* * * * *